United States Patent [19]

Satake

[11] Patent Number: 4,843,957

[45] Date of Patent: Jul. 4, 1989

[54] RICE POLISHING MACHINE OF VERTICAL SHAFT AND FRICTIONAL TYPE

[75] Inventor: Toshihiko Satake, Higashihiroshima, Japan

[73] Assignee: Satake Engineering Co., Ltd., Tokyo, Japan

[21] Appl. No.: 222,962

[22] Filed: Jul. 22, 1988

[30] Foreign Application Priority Data

Jul. 27, 1987 [JP] Japan ..... 62-188513

[51] Int. Cl.[4] ..... B02B 3/00; B02B 3/04; B02B 7/02

[52] U.S. Cl. ..... 99/519; 99/524; 99/605; 99/610; 99/611; 99/617

[58] Field of Search ..... 99/518, 519, 522, 524, 99/525, 488, 528, 600–603, 605–607, 608, 609–611, 617, 620, 622; 426/482, 483; 241/7, 73, 245

[56] References Cited

U.S. PATENT DOCUMENTS

| | | | |
|---|---|---|---|
| 707,211 | 8/1902 | Cornwall | 99/617 X |
| 3,628,582 | 12/1971 | Satake | 99/617 |
| 4,323,006 | 4/1982 | Satake | 99/519 |
| 4,426,922 | 1/1984 | Yamamoto | 99/524 X |
| 4,583,455 | 4/1986 | Salete-Garces | 99/603 X |

*Primary Examiner*—Timothy F. Simone

*Attorney, Agent, or Firm*—Bert J. Lewen; Henry Sternberg

[57] ABSTRACT

Provided is a rice polishing machine of a vertical shaft and frictional type, comprising a vertical tubular member, having a perforated wall; a vertical main shaft rotatably disposed in the tubular member and having one end part and an other end part; a spiral rotor fitted on the one end part of the vertical main shaft; a polishing rotor having an outer peripheral surface on which agitating projection ridges are formed, fitted on the other end part of the main shaft and further having a center axis around which the polishing rotor rotates in a certain rotating direction; and a polishing chamber mainly defined by the tubular member and the polishing rotor and having upper and lower ends one of which is connected with a rice grain feed section and the other of which is connected with a rice grain discharge section, wherein the peripheral surface of the polishing rotor is formed such that the distance between the center axis of the polishing rotor and a part of the peripheral surface of the polishing rotor, which is forward of each of the agitating projection ridges as viewed in the certain rotating direction of the polishing rotor, is smaller than the distance between the center axis of the polishing rotor and a part of the outer peripheral surface, which is rearward of each of the agitating projection ridges.

5 Claims, 8 Drawing Sheets

RICE POLISHING MACHINE OF VERTICAL SHAFT AND FRICTIONAL TYPE

BACKGROUND OF THE INVENTION

The present invention relates to a rice polishing machine of a vertical shaft and frictional type for polishing rice grain fed from one end of a vertical polishing chamber and discharging it from another end thereof.

A conventional rice polishing machine of a vertical shaft and frictional type will be described with reference to FIG. 9 and FIG. 10. Denoted at reference numeral 37 is a rice polishing machine of a vertical shaft and frictional type comprising a substantially vertical polishing tubular member 38 having a perforated wall and a main shaft 39 rotatably disposed in the polishing tubular member, the main shaft 39 having a bottom section fitted with a spiral rotor 40 and an upper section fitted with a polishing rotor 42 having agitating projection ridges 41 formed on it. Rice grain before polishing is fed to the spiral rotor 40 from a rice grain feed section 45 disposed on a side wall of a machine frame through a rice grain feed duct 43 and fed upwardly to a polishing chamber 46 by the spiral rotor 40. The rice grain is subject to the polishing action caused by the rotation of the polishing rotor 42 to be polished in the polishing chamber 46 and the polished rice grain is discharged from a discharge port 47 through a discharge duct 48 to the outside of the machine.

As shown in FIG. 10, however, with the conventional rice polishing machine of a vertical shaft and frictional type, the polishing rotor 42 is formed such that the distance $r_1$ between the center axis of the polishing rotor 42 and a part of the peripheral surface of the polishing rotor, which is forward of each of the agitating projection ridges 41 as viewed in the rotating direction (the direction of the arrow) of the polishing rotor 42, is larger than the distance $r_2$ between the central axis of the polishing rotor 42 and a part of the outer peripheral surface, which is rearward of each of the agitating projection ridges 41. As a result, the polishing pressure applied to a section A in the polishing chamber becomes excessive larger than the polishing pressure applied to a section B. Even though the polishing pressure applied to the section A is properly adjusted, the pressure in the section B is made unnecessarily smaller so that the rice grain in the section B rapidly ascends along the agitating projection ridges in an insufficiently polished condition and discharged, resulting in that the rice grain is polished irregularly On the other hand, when the polishing pressure applied to the section B is properly adjusted, an excessive pressure is applied to the section A, which produces broken grain.

SUMMARY OF THE INVENTION

It is an object of the present invention to overcome the aforesaid drawback by providing a rice polishing machine of a vertical shaft and frictional type capable of applying pressure of a suitable distribution in a polishing chamber and reducing production of spottedly polished or crushed rice grain.

To achieve the object, the present invention has the following arrangement.

According to the present invention, there is provided a rice polishing machine of a vertical shaft and frictional type, comprising a vertical tubular member having a perforated wall; a vertical main shaft rotatably disposed in the tubular member and having one end part and an other end part; a spiral rotor fitted on the one end part of the vertical main shaft; a polishing rotor having an outer peripheral surface on which agitating projection ridges are formed, fitted on the other end part of the main shaft and further having a center axis around which the polishing rotor rotates in a certain rotating direction; and a polishing chamber mainly defined by the tubular member and the polishing rotor and having upper and lower ends one of which is connected with a rice grain feed section and the other of which is connected with a rice grain discharge section, wherein the peripheral surface of the polishing rotor is formed such that the distance between the center axis of the polishing rotor and a part of the peripheral surface of the polishing rotor, which is forward of each of the agitating projection ridges as viewed in the certain rotating direction of the polishing rotor, is smaller than the distance between the center axis of the polishing rotor and a part of the outer peripheral surface, which is rearward of each of the agitating projection ridges.

Rice grain fed to the spiral rotor from a rice grain feed section of the rice polishing machine of a vertical shaft and frictional type is fed by the spiral rotor and polished in the polishing chamber mainly defined by the vertical tubular member having a perforated wall and the polishing rotor. The polished rice grain is discharged from a rice grain discharge section so as to be transferred to a next process. Since a pressure applied to the rice grain in the polishing chamber is so adjusted that it distributes suitably on parts of the peripheral surface of the polishing rotor which are just forward of the agitating projection ridges and on a remaining part of the peripheral surface, it is possible to prevent insufficiently polished rice grain from ascending rapidly along the agitating projection ridges and broken rice grain due to an excessive pressure is scarcely produced.

DESCRIPTION OF THE PREFERRED EMBODIMENTS

The present invention will be described hereinbelow with reference to the accompanying drawings.

Figure 1A:
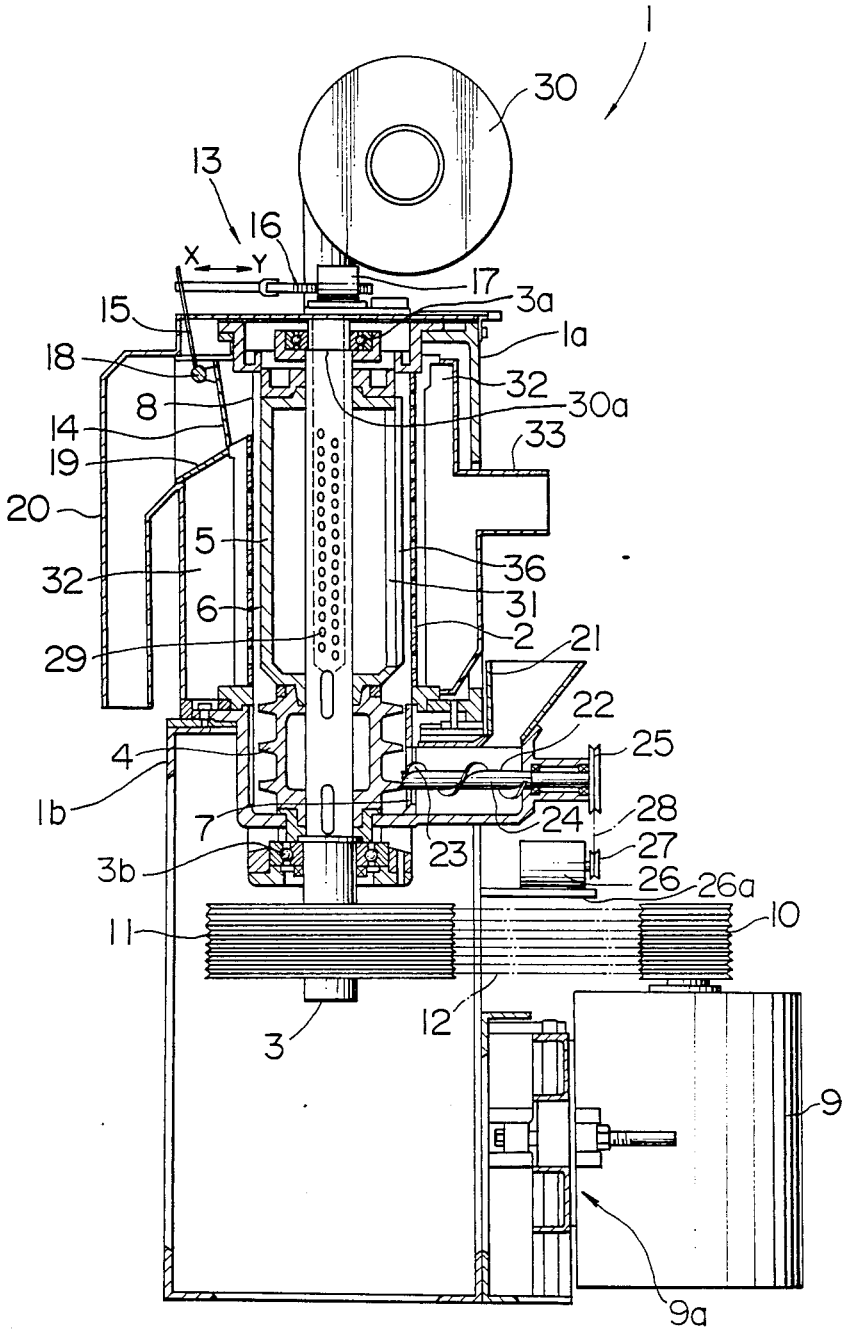
FIG. 1A is a side cross-sectional view of a rice polishing machine of a vertical shaft and frictional type to which the present invention is applied.

FIG. 1A shows a rice polishing machine of a vertical shaft and frictional type in which one aspect of the present invention is incorporated as a first embodiment.

Referring to FIG. 1A, reference numeral 1 generally denotes the above-mentioned rice polishing machine having a vertical main shaft 3 which is disposed rotatably in a vertical tubular member 2 having a perforated wall and which is fitted with its lower section in a spiral rotor 4 and with its upper section in a polishing rotor 5 formed on its outer peripheral surface with a plurality of agitating projection ridges 36. This main shaft 3 is rotatably journalled at its both axial ends by bearings 3*a*, 3*b* to a machine frame 1*a* mounted on a base housing 1*b*. The vertical tubular member 2 has a polygonal cross-sectional shape having sides of a number which is a common multiple of the number of the agitating projection ridges 36 and defines mainly therein, together with the polishing rotor 5, a polishing chamber 6 having its lower end part connected with a rice grain supply section 7 and its upper end part connected with a rice grain discharge section 8. V-belts 12 are stretched between a motor pulley 10 coupled to a main motor 9 and a pulley 11 coupled to the main shaft 3. The main motor 9 is secured to the base housing 1*b* by means of a fixing member 9*a*.

Figure 1B:
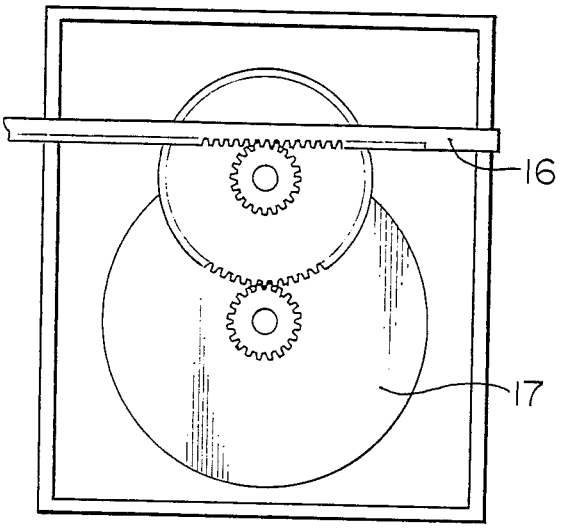
FIG. 1B is an enlarged plan view illustrating a gear train of a resistance adjusting unit.

A resisting plate 14 coupled to an automatic resistance adjusting unit 13 is disposed on the rice grain discharge section 8 for regulating a flow of the rice grain discharged from the rice grain discharge section 8. The resisting plate 14 is coupled to a rack 16 through a lever 15 made of resilient materials and the rack 16 is associatingly coupled to a reversible servo-motor 17 through a gear train as shown in FIG. 1B. When the rack 16 is moved horizontally by the servo-motor 17 rotating in either of the normal and reverse directions, the lever 15 rotates around the axis 18 of the resisting plate 14 so that the resisting plate 14 moves in the either of the directions X, Y to and from the rice grain discharge section 8. There is provided a downstream duct 19 coupled to the rice grain discharge section 8, to which a discharge duct 20 is coupled.

A feed hopper 21 is communicated with a rice grain feed unit 22 and a pulley 25 mounted on a conveyer shaft 24 having a spiral member 23 wound around it is coupled to a pulley 27 of a motor 26 which is mounted to the base housing 1*b* by a bracket 26*a*, through a V-belt 28. In addition, the rice grain feed unit 22 is communicated with a rice grain feed section 7.

A hollow main shaft 3 which is opened at its upper end but blinded, i.e. closed off, at its lower end has its peripheral wall through which a number of vent holes 29 are formed and its hollow section is communicated with the air discharge side end 30*a* of a blower 30, having a slight gap between the blower 30 and the shaft 3. Denoted at reference numeral 31 is an air ejecting hole formed in the polishing rotor 5 and a rice bran removing chamber 32 surrounding the outer periphery of the perforated wall 2, communicates with a cyclone (not shown) or the like through a rice bran removing duct 33.

Figure 2:
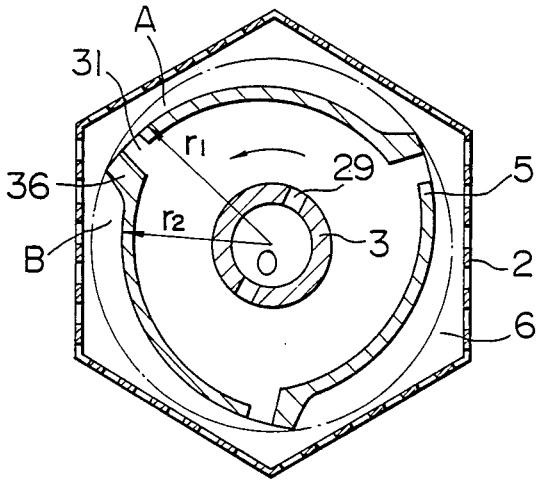
FIGS. 2 and 3 are front cross-sectional views of a frictional polishing rotor.

As shown in FIG. 2, the polishing rotor 5 formed eccentrically has the agitating projection ridges 36 formed at three spaced apart positions on its peripheral surface. The peripheral surface is formed such that the distance $r_2$ between the center axis O of the polishing rotor 5 and a part of the peripheral surface of the polishing rotor 5, which is formed forward of each of the agitating projection ridges as viewed in the rotating direction of the polishing rotor 5, is smaller than the distance $r_1$ between the center axis O of the polishing rotor and a part of the outer peripheral surface, which is rearward of each of the agitating projection ridges.

It is noted that, in the above-mentioned arrangement, the polishing chamber 6 has a polygonal shape having sides of a number which is an integer times as many as the number of the agitating projection ridges 36 on the polishing rotor 5.

Figure 5:
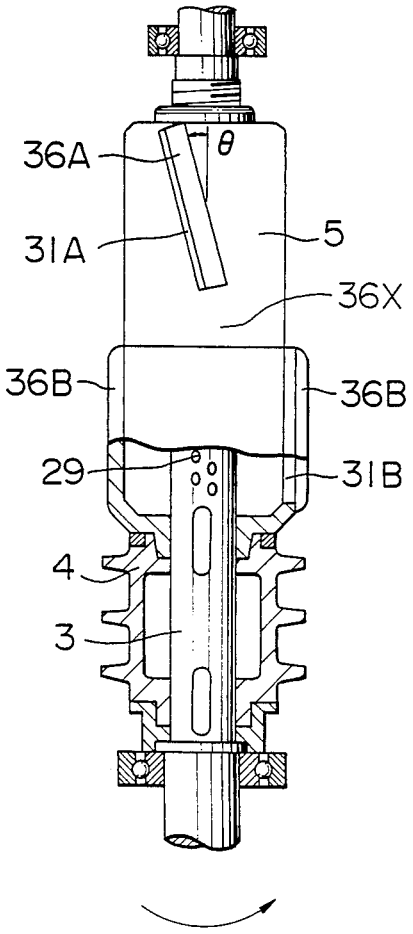
FIG. 5 is a partly cross-section side view illustrative of another embodiment of an polishing rotor.

With an upward feed type rice polishing machine of a vertical shaft, rice grain located in its lower section of the polishing chamber is subject to a large pressure caused by the dead load of the rice grain corresponding to a process length of the polishing chamber. Since rice polishing effected by a rice polishing machine, in particular by a rice polishing machine of a frictional type requires the application of a larger pressure at the initial stage of polishing than that at the final stage of polishing, the upward feed type rice polishing machine is advantageous in use. However, in a certain case since an upward feed action is necessary in the rice polishing, the inclination at angle $\theta$ with respect to a vertical line is given to agitating projection ridges as shown in FIG. 5, in order to convert the torque of the polishing rotor 5 into a lift force.

Next, operation of the above-mentioned arrangement will be described. When the main motor 9 and the motor 26 are driven, rice grain is fed to the rice grain feed unit 22 through the feed hopper 21. Then the rice grain is fed into rice grain supply section 7 by the spiral member 23, and is lifted to the polishing chamber 6 by the spiral rotor 4. The rice grain is polished by being subjected to a polishing action caused by the rotation of the polishing rotor 5 during lift of the rice grain.

Figure 3:
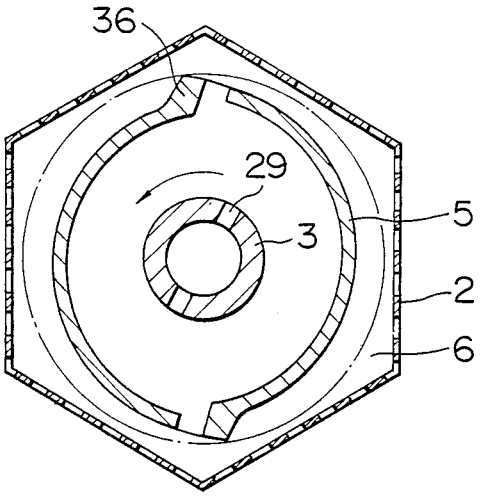

In the above-mentioned arrangements, as shown in FIG. 2, the peripheral surface of the polishing rotor 5 is formed such that the distance $r_2$ between the center axis O of the polishing rotor 5 and a part of the peripheral surface of the polishing rotor 5, which is formed forward of each of the agitating projection ridges as viewed in a certain rotating direction of the polishing rotor 5, is smaller than the distance $r_1$ between the center axis O of the polishing rotor and a part of the outer peripheral surface, which is rearward of each of the agitating projection ridges. Therefore, the distribution of the pressure applied to the section A and the section B of the polishing chamber 6 may be adjusted such that the rice grain in the section B is not made to an excessively sparse condition. As a result, insufficiently polished rice grain is scarcely moved upwardly along the agitating projection ridges 36 so as to be discharged to the outside of the machine, and agitation is promoted among particles in the rice grain, which prevents the rice grain from being spottedly polished. In addition, as shown in FIG. 3, a rice polishing machine of small capacity has a polishing rotor 5 with its peripheral surface on which agitating projection ridges 36 are formed at two spaced apart positions, the ridges 36 having the same effect.

A bran removing action is effected by the rice bran removing air which is supplied by the blower 30 and ejected from the air ejecting hole 31 through the vent holes 29 during polishing of the rice grain. Dust such as rice bran or the like produced by a polishing action in the polishing chamber 6 is discharged together with the rice brain removing air into the rice bran removing chamber 32 from holes formed in the vertical tubular member 2 having the perforated wall and fed to a rice bran collecting unit such as a cyclone (not shown) from the rice bran removing duct 33.

The polished rice grain then reaches the rice grain discharge section 8 is discharged overcoming the resilient force which is exerted to the resisting plate 14 by the lever 15 in the automatic resistance adjusting unit 13. A degree of polishing can be adjusted in such a way that the servo-motor 17 is rotated in either the normal or reverse direction so as to control the resilient force exerted to the resisting plate 14. Then, the rice grain fed out overcoming the resisting plate 14, is discharged to the outside of the machine through the downstream duct 19 and the discharge duct 20.

Figure 4:
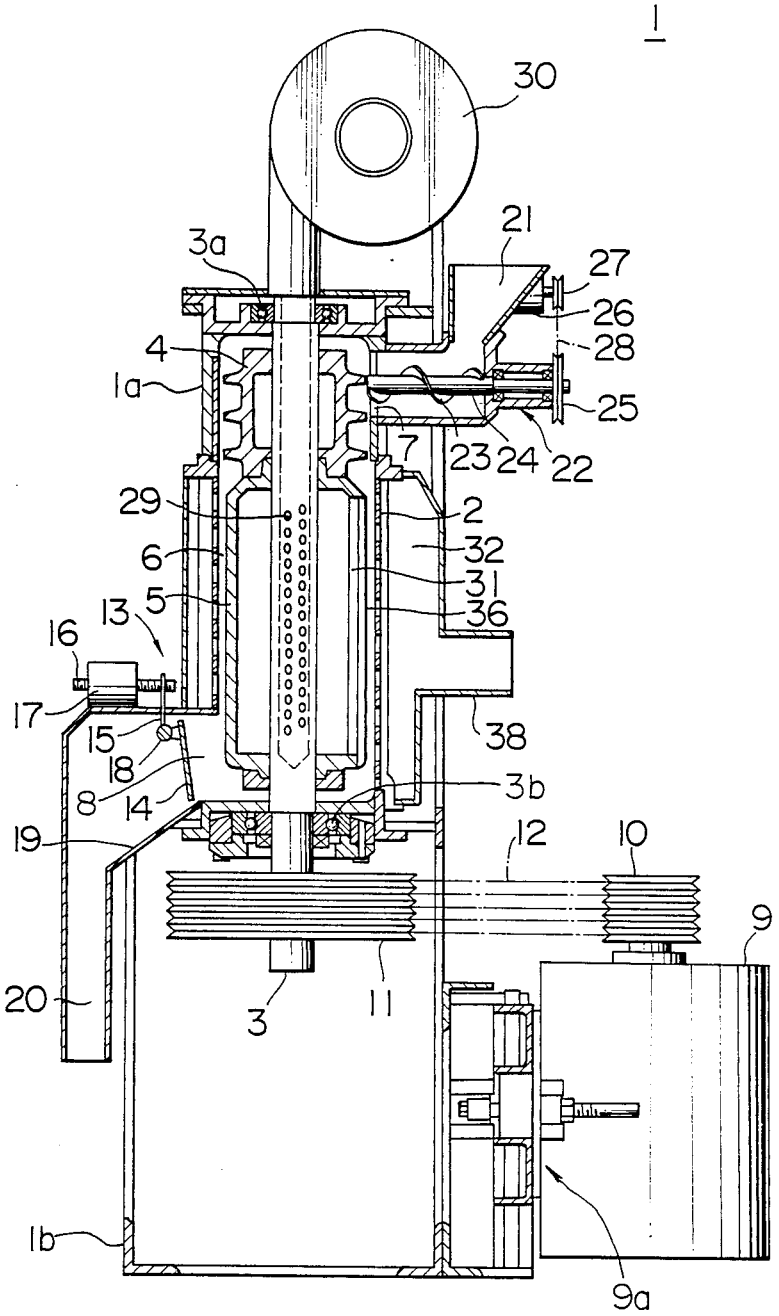
FIG. 4 is a side cross-sectional view illustrative of another embodiment.

Next, FIG. 4 shows a rice polishing machine of vertical shaft and frictional type employing a natural descending system, as a second embodiment of the present invention, in which the like reference numerals designate the like parts as those shown in FIG. 1 while detailed description of the like parts will be omitted from the specification in order to avoid duplication in explanation unless it is necessary. In this embodiment, a main shaft 3 rotatably disposed has its upper section fitted with a spiral rotor 4 and its lower section fitted with a polishing rotor 5. A tubular member 2 having a perforated wall is provided around the spiral rotor 5, forming a space serving as a polishing chamber 6 around the rotor 5. The polishing chamber 6 has its upper end connected to a rice grain feed section 7 and its lower end connected to a rice grain discharge chamber 8. The main shaft 3 is driven by a main motor 9 at its lower end and a blower 30 for ejecting air supplies air under pressure to the main shaft 30 at its upper end. The rice grain feed section 7 is provided with a rice grain feed unit 22 and the rice grain discharge section is provided with an automatic resistance adjusting unit 13 like the first embodiment.

Operation of the present embodiment will be described. Rice grain fed at prescribed flow rate by the rice grain feed unit 22 is gradually fed into the polishing chamber 6 under the rice grain feed action caused by the spiral rotor 4 so as to reach the rice grain discharge section 8 while it is subjected to the polishing action in the polishing chamber 6 and then is discharged overcoming a resisting plate 14 of an automatic resistance adjusting unit 13. In this rice polishing machine of a vertical shaft and frictional type employing the natural flow-down system, since rice grain is effected by gravity and further a pressure due to the dead weight of the rice grain is added to the rice grain on the discharge side at an lower end so that a high pressure is effected in this section, agitating projection ridges 36 inclined at an angle $\theta$ with respect to a vertical line as shown in FIG. 5 sometimes reduces the above-mentioned high pressure.

FIG. 5 shows a third embodiment of the present invention, in which a polishing rotor 5 and those relating thereto are alone shown. The polishing rotor 5 has its upper half section formed with agitating projection ridges 36A and an air ejecting hole 31*a* and its lower half section formed with agitating projection ridges 36B and an air ejecting hole 31B, the circumferential positions of the ridges 36A and the holes 31A being parted from those of the ridges 36B and holes 31B, respectively, as far as possible. In this arrangement, since there is a section 36X where the agitating projection ridges are not formed on the peripheral surface of the polishing rotor 5, the rice grain fed upwardly by a spiral rotor 4 is subject to the polishing action caused by the agitating projections 36B at first and then increased agitating and mixing action is developed among the rice grain at the section 36X where the agitating projection ridges are not formed. Next, the rice grain is polished by being subjected to the polishing action caused by the agitating projections 36A and is discharged to the outside of the machine. Since the agitating projections 36A and the agitating projections 36B are formed being parted from each other in the circumferential direction, when the rice grain which is moving upward along the agitating projections 36B passes through the upper ends of the agitating projections 36B, it is agitated and mixed, and then it is polished again by the agitating projections 36A. With the arrangement, a tendency for insufficiently polished rice grain to be discharged to the outside of the machine is prevented substantially because the rice grain is polished more sufficiently.

Figure 6:
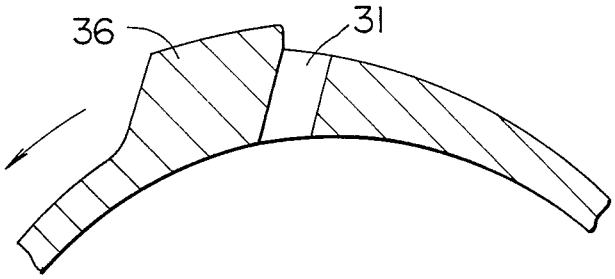
FIGS. 6, 7, and 8 are partly sectional side views illustrative of a part of an polishing rotor.
Figure 7:
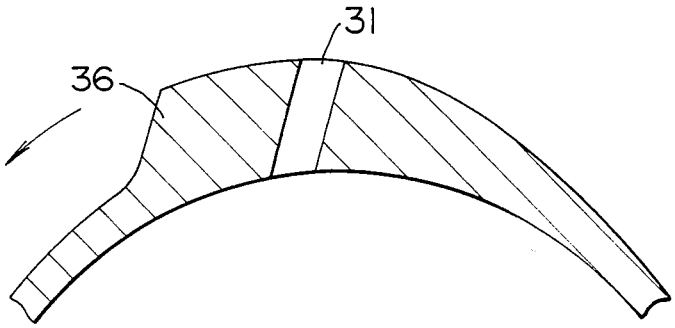
Figure 8:
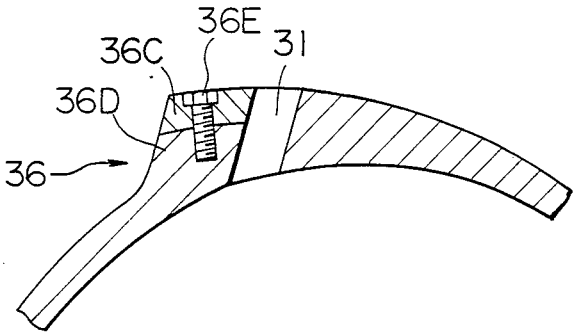
Figure 9:
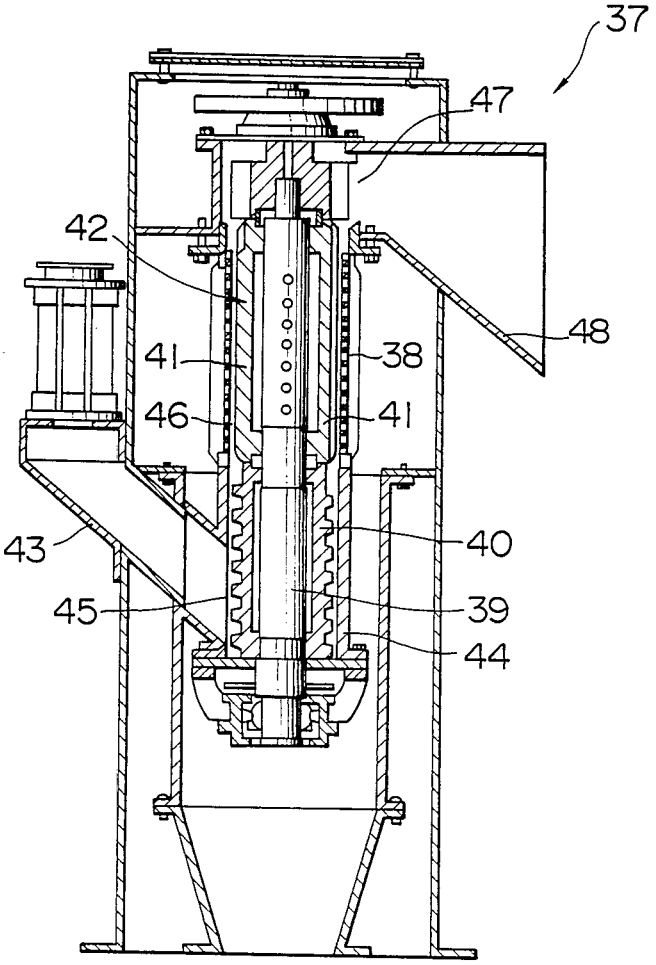
FIG. 9 PRIOR ART
FIGS. 9 and 10 are diagrams illustrative of a prior art.
Figure 10:
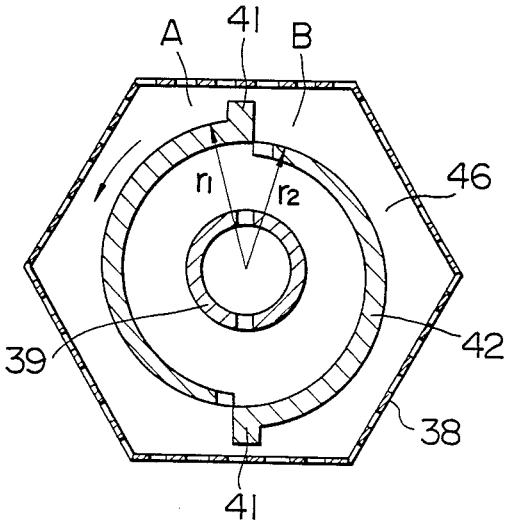
FIG. 10 PRIOR ART

FIGS. 6 and 7 show modifications of the agitating projection ridges 36 and the air ejecting hole 31 of different shapes. FIG. 6 shows a modification of the agitating projection ridge 36 having a step defined on the rear side thereof in the rotational direction and the air ejecting hole 31 is directed slightly rearward in the rotational direction. FIG. 7 shows a modification of the agitating projection ridge 36 without a step and having the air ejecting hole directed in the retracted direction. FIG. 8 shows a modification having a replaceable projection ridge in which the tip part 36C of the agitating ridge 36 is formed separately from the base part 36D of the ridge 36, and is replaceably attached to the base part 36D by means of bolts 36E. Since the tip part 36C is liable to be rapidly worn, this arrangement is preferable.

According to the rice polishing machine of the vertical shaft and frictional type of the present invention, the peripheral surface is formed such that the distance between the center axis O of the polishing rotor 5 and a part of the peripheral surface of the polishing rotor 5, which is formed forward of each of the agitating projection ridges as viewed in the rotating direction of the polishing rotor 5, is smaller than the distance between the center axis O of the polishing rotor and a part of the outer peripheral surface, which is rearward of each of the agitating projection ridges. As a result, the pressure distribution can be suitably adjusted in the circumferential direction. Thereby a section where an extremely low pressure is applied, i.e. a section where the rice grain is in an extremely sparse condition, which is a drawback of a conventional rice polishing machine of a vertical shaft, is eliminated, resulting in that the rice grain moves at a substantially uniform speed and that the rice grain is subjected to vigorous agitation one another which prevents substantially the rice grain from being irregularly polished. In addition, the present invention has such a multiplied effect such that because substantially no rice grain is polished irregularly, the maximum polishing pressure within a safety limit can be applied so as to obtain polished rice perfectly free of sprouts in a polishing process of even a short process time, which has conventionally been regarded as very difficult to attain.

What is claimed is:

1. In a rice polishing machine of a vertical flow and frictional polishing type, comprising a vertical tubular member having a perforated wall; a vertical main shaft rotatably disposed in the tubular member and having one end part and an other end part; a spiral rotor fitted on the one end part of the vertical main shaft; a polishing rotor having an outer peripheral surface on which agitating projection ridges are formed at peripherally spaced apart positions, fitted on the other end part of the main shaft and further having a center axis around which the polishing rotor rotates in a certain rotating direction; and a polishing chamber defined mainly by the tubular member and the polishing rotor, and having upper and lower ends one of which is connected with a rice grain feed section and the other of which is connected with a rice grain discharge section, the improvement wherein the peripheral surface of the polishing rotor is formed correspondingly eccentrically such that the distance between the center axis of the polishing rotor and a part of the peripheral surface of the polishing rotor, which is forward of each of the agitating projection ridges as viewed in the certain rotating direction of the polishing rotor, is smaller than the distance between the center axis of the polishing rotor and a part of the outer peripheral surface, which is rearward of each of the agitating projection ridges as viewed in said rotating direction.

2. A rice polishing machine as set forth in claim 1, wherein said lower end of said polishing chamber is connected with said rice grain feed section, and said upper end of said polishing chamber is connected with said rice grain discharge section.

3. A rice polishing machine as set forth in claim 1, wherein said agitating projection ridges are provided in the form of a base part integral with the polishing rotor and an outer replaceable tip part removably connected to the base part.

4. A rice polishing machine as set forth in claim 2, wherein said agitating projection ridges are provided in the form of a base part integral with the polishing rotor and an outer replaceable tip part removably connected to the base part.

5. A rice polishing machine as set forth in claim 1, wherein the peripheral surface of the polishing rotor has an upper polishing section containing said agitating projection ridges and a lower polishing section also containing said agitating projection ridges, the upper and lower polishing sections being arranged to form therebetween a separate section free from said agitating projection ridges for permitting increased rice grain agitating and mixing without polishing during rice grain travel between the upper and lower polishing sections.

* * * * *